US006146821A

United States Patent [19]

Strijckers

[11] Patent Number: 6,146,821

[45] Date of Patent: Nov. 14, 2000

[54] (PHOTO) THERMOGRAPHIC MATERIAL WITH A BLUE BACKGROUND

[75] Inventor: Hans Strijckers, Oudergem, Belgium

[73] Assignee: Agfa-Gevaert, Mortsel, Belgium

[21] Appl. No.: 09/098,973

[22] Filed: Jun. 17, 1998

Related U.S. Application Data

[60] Provisional application No. 60/058,283, Sep. 9, 1997.

[30] Foreign Application Priority Data

Jul. 4, 1997 [EP] European Pat. Off. ..... 97202035

[51] Int. Cl.[7] ..... G03C 1/498

[52] U.S. Cl. ..... 430/617; 430/348; 430/510; 430/517

[58] Field of Search ..... 430/619, 617, 430/517, 510, 350, 348

[56] References Cited

U.S. PATENT DOCUMENTS 4,477,562 10/1984 Zeller-Pendrey .
5,783,380 7/1998 Smith et al. ..... 430/619

FOREIGN PATENT DOCUMENTS 2029980 8/1991 Canada .
1502670 3/1978 United Kingdom .

*Primary Examiner*—Thorl Chea
*Attorney, Agent, or Firm*—Baker Botts L.L.P.

[57] ABSTRACT

A (photo) thermographic recording material comprising a substantially colourless support and a (photo-addressable) thermosensitive element containing a substantially light-insensitive organic silver salt, an organic reducing agent for the substantially light-insensitive organic silver salt in thermal working relationship therewith (, photosensitive silver halide is catalytic association with the substantially light-insensitive organic silver salt) and a binder, characterized in that a blue pigment or dye having a maximum absorption wavelength of from 550 to 700 nm is present in the thermosensitive element and/or any other layer on either side of the support which provides a background for viewing in transmission images produced with the (photo) thermographic recording material; and a (photo) thermographic recording process therefor.

3 Claims, No Drawings

(PHOTO) THERMOGRAPHIC MATERIAL WITH A BLUE BACKGROUND

DESCRIPTION

The application claims the benefit of U.S. Provisional Application Ser. No. 06/058,283 filed Sep. 9, 1997.

FIELD OF THE INVENTION

The present invention relates to substantially light-insensitive thermographic and photothermographic materials having a background for viewing in transmission images produced therewith and recording processes therefor.

BACKGROUND OF THE INVENTION

Thermal imaging or thermography is a recording process wherein images are generated by the use of imagewise modulated thermal energy.

In thermography three approaches are known:

1. Imagewise transfer of an ingredient necessary for the chemical or physical process bringing about changes in colour or optical density to a receptor element containing other of the ingredients necessary for the chemical or physical process followed by uniform heating to bring about the changes in colour or optical density.
2. Thermal dye transfer printing wherein a visible image pattern is formed by transfer of a coloured species from an imagewise heated donor element onto a receptor element.
3. Direct thermal formation of a visible image pattern by imagewise heating of a recording material containing matter that by chemical or physical process changes colour or optical density.

Thermographic materials of type 3 become photothermographic if a photosensitive agent is present which after exposure to UV, visible or IR light is capable of catalyzing or participating in a thermographic process bringing about changes in colour or optical density. Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

Particular sorts of thermographic film have a blue background, which can vary in tone and optical density, for example, for applications such as the printing of medical images for viewing in transmission. This blue background is not aesthetic having a number of functional purposes, for example: rendering the brownish tone of developed silver images blue/black, preventing over-exposure of the eyes of the viewer upon viewing in transmission with a view-box and improving image sharpness by reducing light scattering. Current practice is to achieve this blue background by incorporating one or more blue pigments or dyes into the support, thereby avoiding possible interference between the pigment or dye necessary to obtain the blue background and the other functional ingredients in the layer structure which makes up a thermographic material. However, this practice requires pigments and dyes which can withstand the high temperatures involved in kneading these dyes and pigments into the polymer (conventionally polyethylene terephthalate), in extruding the polymer to produce the polymer sheet, in stretching the polymer sheet and in conditioning the resulting support to reduce crimp upon later exposure to high temperatures during coating, drying, conditioning and use. Furthermore, this practice also requires the holding of an inventory of different sorts of blue background support as well as substantially colourless supports for producing a complete range of thermographic materials e.g. from graphics applications requiring a substantially colourless support to medical applications requiring a blue background support. The holding of such an inventory of different sorts of blue background support as well as substantially colourless supports incurs financial penalties due to additional storage and logistical requirements as well as increasing the possibility, easy in the subdued lighting required for the coating of photosensitive thermographic products, of using the "wrong" sort of support for the production of a particular thermographic material. This is in addition to possible financial penalties incurred by the possible necessary use of more expensive pigments and dyes in the colouring of the support due to the harsher conditions involved in the incorporation process. There is therefore a necessity for thermographic materials having different blue backgrounds, which can utilize a substantially colourless support.

OBJECTS OF THE INVENTTON

It is therefore an object of the present invention to provide a substantially light-insensitive thermographic recording material having a blue background which can utilize a substantially colourless support.

It is therefore a further object of the present invention to provide a process for producing a substantially light-insensitive thermographic recording material having a blue background which can utilize a substantially colourless support.

It is therefore another object of the present invention to provide a photothermographic recording material having a blue background which can utilize a substantially colourless support.

It is therefore a still further object of the present invention to provide a process for producing a photothermographic recording material having a blue background which can utilize a substantially colourless support.

Other objects and advantages of the present invention will become clear from the further description and examples.

SUMMARY OF THE INVENTION

According to the present invention a substantially light-insensitive thermographic recording material is provided comprising a substantially colourless support and a thermosensitive element containing a substantially light-insensitive organic silver salt, an organic reducing agent for the substantially light-insensitive organic silver salt in thermal working relationship therewith and a binder, characterized in that a blue pigment or dye having an absorption maximum in the wavelength range from 550 to 700 nm is present in the thermosensitive element and/or any other layer on either side of the support which provides a background for viewing in transmission images produced with said thermographic recording material.

According to the present invention a thermographic recording process is also provided comprising the steps of: bringing a substanially light-insensitive thermographic recording material, as referred to above, into the proximity of a heat source; imagewise heating of the thermographic recording material with the heat source; and removing the thermographic recording material from the heat source.

According to the present invention a photothermographic recording material excluding a palladium compound is also provided comprising a substantially colourless support and a photo-addressable thermally developable element containing a substantially light-insensitive organic silver salt, an organic reducing agent for the substantially light-insensitive organic silver salt in thermal working relationship therewith, photosensitive silver halide in catalytic association with the substantially light-insensitive organic silver salt and a binder, characterized in that a blue pigment or dye having an absorption maximum in the wavelength range from 550 to 700 nm is present in the photo-addressable thermally developable element and/or any other layer on either side of the support.

A photothermographic recording process is also provided, according to the present invention, comprising the steps of: bringing a photothermographic recording material, as referred to above, into the proximity of a source of actinic radiation; image-wise exposing the photothermographic recording material with the source of actinic radiation; bringing the image-wise exposed photothermographic recording material into the proximity of a heat source; uniformly heating the image-wise exposed photothermographic recording material; and removing the photothermographic recording material from the heat source.

DETAILED DESCRIPTION OF THE INVENTION

Substantially

By substantially light-insensitive is meant not intentionally light sensitive. By a substantially colourless support is meant that no colouring agent has been intentially added.

Blue Pigments and Dyes

In a preferred embodiment of the substantially light-insensitive thermographic and photothermographic materials, according to the present invention, the blue pigment or dye has an absorption maximum in the wavelength range from 570 to 630 nm. Suitable blue pigments and dyes for use in the present invention are selected from the group consisting of phthalocyanine dyes, phthalocyanine pigments, indanthrone dyes and indantrone pigments. It is clear that a mixture of blue pigments or dyes can also be used in the present invention.

The blue pigments for use in the present invention are preferably dispersed in the coating medium by the methods described e.g. in EP-A 569 074. Further dispersion techniques which may be used are described in e.g. EP-A 552 646, EP-A 595 821 and U.S. Pat. No. 4,900,652. Preferred mean particle sizes of the dispersed pigments are not more than 2 $\mu$m, more preferably not more than 1 $\mu$m and most preferably not more than 0.5 $\mu$m.

By making use of such blue pigments and dyes substantially light-insensitive thermographic and photothermographic materials with a blue background can be obtained which render the brownish tone of developed silver images blue/black, prevent over-exposure of the eyes of the viewer upon viewing in transmission with a view-box and improve image sharpness by reducing light scattering, while having the additional financial benefits of a reduced inventory of supports, less storage capacity for supports and a reduced probability of coating taking place on the wrong support.

Suitable blue dyes/pigments for use in the present invention are:

BLUE DYE 1=Ceres Blue from Bayer AG [N,N'-2,6-diethyl-4-methylphenyl) -1,4, -diamino-anthraquinone]

BLUE DYE 2=Orasol Blue from Ciba Geigy AG

BLUE DYE 3=Reflex Blue R54 from Hoechst AG

Thermosensitive Element

The thermosensitive element used in the present invention comprises a substantially light-insensitive organic silver salt and an organic reducing agent therefor in thermal working relationship therewith and a binder. The element may comprise a layer system in which the ingredients may be dispersed in different layers, with the proviso that the substantially light-insensitive organic silver salt and the organic reducing agent are in thermal working relationship with one another i.e. during the thermal development process the reducing agent must be present in such a way that it is able to diffuse to the substantially light-insensitive organic silver salt particles so that reduction of the organic silver salt can take place.

Substantially Light-insensitive Organic Silver Salts

Preferred substantially light-insensitive organic silver salts used in the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps"; silver dodecyl sulphonate described in U.S. Pat. No. 4,504,575; and silver di-(2-ethylhexyl)-sulfosuccinate described in EP-A 227 141. Modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermosensitive silver image. Silver imidazolates and the substantially light-insensitive inorganic or organic silver salt complexes described in U.S. Pat. No. 4,260,677 are also suitable.

The term substantially light-insensitive organic silver salt for the purposes of the present invention also includes mixtures of organic silver salts.

Emulsion of Organic Silver Salt

A suspension of particles containing a substantially light-insensitive silver salt of an organic carboxylic acid may be obtained by using a process, comprising simultaneous metered addition of an aqueous solution or suspension of an organic carboxylic acid or its salt; and an aqueous solution of a silver salt to an aqueous liquid, as described in EP-A 754 969.

Organic Reducing Agent

Suitable organic reducing agents for the reduction of the substantially light-insensitive organic silver salts are organic compounds containing at least one active hydrogen atom linked to O, N or C, such as is the case with, mono-, bis-, tris- or tetrakis-phenols; mono- or bis-naphthols; di- or polyhydroxy-naphthalenes; di- or polyhydroxybenzenes; hydroxymonoethers such as alkoxynaphthols, e.g. 4-methoxy-1-naphthol described in U.S. Pat. No. 3,094,41; pyrazolidin-3-one type reducing agents, e.g. PHENIDONE™; pyrazolin-5-ones; indan-1,3-dione derivatives;

hydroxytetrone acids; hydroxytetronimides; 3-pyrazolines; pyrazolones; reducing saccharides; aminophenols e.g. METOL™; p-phenylenediamines, hydroxylamine derivatives such as for example described in U.S. Pat. No. 4,082,901; reductones e.g. ascorbic acids; hydroxamic acids; hydrazine derivatives; amidoximes; n-hydroxyureas; and the like, see also U.S. Pat. Nos. 3,074,809, 3,080,254, 3,094,417 and 3,887,378.

Among useful aromatic di- and tri-hydroxy compounds having at least two hydroxy groups in ortho- or para-position on the same aromatic nucleus, e.g. benzene nucleus, hydroquinone and substituted hydroquinones, catechol and substituted catechols are preferred.

Among substituted catechol, i.e. reducing agents containing at least one benzene nucleus with two hydroxy groups (—OH) in ortho-position, are preferred 1,2-dihydroxybenzoic acid, 3-(3',4'-dihydroxyphenyl)propionic acid, pyrogallol, polyhydroxy spiro-bis-indane compounds, gallic acid, gallic acid esters e.g. methyl gallate, ethyl gallate and propyl gallate, tannic acid and 3,4-dihydroxy-benzoic acid esters are preferred. Particularly preferred catechol-type reducing agents are described in EP-A 692 733 and EP-A 599 369.

Polyphenols such as the bisphenols used in the 3M Dry Silver™ materials, sulfonamide phenols such as used in the Kodak Dacomatic™ materials, and naphthols are particularly preferred for photothermographic recording materials with photo-addressable thermally developable elements on the basis of photosensitive silver halide/organic silver salt/reducing agent.

During the thermal development process the reducing agent must be present in such a way that it is able to diffuse to the substantially light-insensitive organic silver salt particles so that reduction of the organic silver salt can take place.

Molar Ratio of Reducing Agent:Organic Silver Salt

The silver image density depends on the coverage of the above defined reducing agent(s) and organic silver salt(s) and has preferably to be such that, on heating above 80° C., an optical density of at least 1.5 can be obtained. Preferably at least 0.10 moles of reducing agent per mole of organic silver salt is used.

Auxiliary Reducing Agents

The above mentioned reducing agents being considered as primary or main reducing agents may be used in conjunction with so-called auxiliary reducing agents. Auxiliary reducing agents that may be used in conjunction with the above-mentioned primary reducing agents are sulfonamidophenols as described in the periodical Research Disclosure, February1979, item 17842, in U.S. Pat. No. 4,360,581 and 4,782,004, and in EP-A 423 891.

Other auxiliary reducing agents that may be used in conjunction with the above mentioned primary reducing agents are sulfonyl hydrazide reducing agents such as disclosed in U.S. Pat. No. 5,464,738, trityl hydrazides and formyl-phenyl-hydrazides such as disclosed in U.S. Pat. No. 5,496,695 and organic reducing metal salts, e.g. stannous stearate described in U.S. Pat. No. 3,460,946 and 3,547,648.

Binder

The binder for the thermosensitive element or photo-addressable thermally developable element used in the present invention may be coatable from a solvent or aqueous dispersion and is itself film-forming or must be used together with a film-forming binder.

Film-forming binders coatable from a solvent dispersion and usable in the present invention may be all kinds of natural, modified natural or synthetic resins or mixtures of such resins, wherein the organic silver salt can be dispersed homogeneously: e.g. polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. A particularly suitable polyvinyl butyrals containing a minor amount of vinyl alcohol units are marketed under the trade names BUTVAR™ B76 and BUTVAR™ B79 of Monsanto USA and provide a good adhesion to properly subbed polyester supports The film-forming binder coatable from an aqueous dispersion used in the present invention may be all kinds of transparent or translucent water-dispersible or water soluble natural, modified natural or synthetic resins or mixtures of such resins, wherein the organic silver salt can be dispersed homogeneously for example proteins, such as gelatin and gelatin derivatives (e.g. phthaloyl gelatin), cellulose derivatives, such as carboxymethylcellulose, polysaccharides, such as dextran, starch ethers etc., galactomannan, polyvinyl alcohol, polyvinylpyrrolidone, acrylamide polymers, homo- or co-polymerized acrylic or methacrylic acid, latexes of water dispersible polymers, with or without hydrophilic groups, or mixtures thereof. Polymers with hydrophilic functionality for forming an aqueous polymer dispersion (latex) are described e.g. in U.S. Pat. No. 5,006,451, but serve therein for forming a barrier layer preventing unwanted diffusion of vanadium pentoxide present as an antistatic agent.

Weight Ratio of Binder to Organic Silver Salt

The binder to organic silver salt weight ratio is preferably in the range of 0.2 to 6, and the thickness of the recording layer is preferably in the range of 5 to 50 μm.

Thermal Solvents

The above mentioned binders or mixtures thereof may be used in conjunction with waxes or "heat solvents" also called "thermal solvents" or "thermosolvents" improving the reaction speed of the redox-reaction at elevated temperature. A "heat solvent", as used in the present invention, is a non-hydrolyzable organic material which is solid in the recording layer at temperatures below 50° C. but becomes a plasticizer for the recording layer in the heated region and/or is a liquid solvent for at least one of the redox-reactants, e.g. the reducing agent for the organic silver salt, at a temperature above 60° C.

Polycarboxylic Acids and Anhydrides Thereof

According to the (photo)thermographic recording material of the present invention the thermosensitive element (or photo-addressable thermally developable element) may also contain at least one polycarboxylic acid and/or anhydride thereof in a molar percentage of at least 20 with respect to all the organic silver salt(s) present and in thermal working relationship therewith. Particularly suitable are saturated aliphatic dicarboxylic acids containing at least 4 carbon atoms, e.g. succinic acid, glutaric acid, adipic acid, pimelic acid, suberic acid, azelaic acid, sebacic acid, nonane-dicarboxylic acid, decane-dicarboxylic acid and undecane-dicarboxylic acid.

Suitable unsaturated dicarboxylic acids are: maleic acid, citraconic acid, itaconic acid and aconitic acid. Suitable polycarboxylic acids are citric acid and derivatives thereof, acetonedicarboxylic acid, iso-citric acid and α-ketoglutaric acid.

Preferred aromatic polycarboxylic acids are ortho-phthalic acid and 3-nitro-phthalic acid, tetrachlorophthalic acid, mellitic acid, pyromellitic acid and trimellitic acid and the anhydrides thereof.

Toning Agent

In order to obtain a neutral black image tone in the higher densities and neutral grey in the lower densities the thermosensitive or photo-addressable thermally developable element preferably contains in admixture with the organic silver salts and reducing agents a so-called toning agent known from thermography or photothermography.

Suitable toning agents are succinimide, phthalazine and the phthalimides and phthalazinones within the scope of the general formulae described in U.S. Pat. No. 4,082,901 and the toning agents described in U.S. Pat. Nos. 3,074,809, 3,446,648 and 3,844,797. Particularly useful toning agents are the heterocyclic toner compounds of the benzoxazine dione or naphthoxazine dione type as described in GB-P 1,439,478, U.S. Pat. No. 3,951,660 and U.S. Pat. No. 5,599,647.

Other Additives

In addition to the ingredients the thermosensitive element or photo-addressable thermally developable element may contain additives such as free fatty acids, surface-active agents, e.g. non-ionic antistatic agents including a fluorocarbon group e.g. $F_3C(CF_2)_6CONH(CH_2CH_2O)$—H; silicone oil, e.g. BAYSILONE™ Öl A (from BAYER AG, GERMANY); ultraviolet light absorbing compounds; silica; colloidal silica; fine polymeric particles, e.g. of poly (methylmethacrylate); and/or optical brightening agents.

Support

The support for the (photo)thermographic recording material according to the present invention may be transparent or translucent e.g. made of a cellulose ester, e.g. cellulose triacetate; corona and flame treated polypropylene; polystyrene; polymethacrylic acid ester; polycarbonate or polyester, e.g. polyethylene terephthalate or polyethylene naphthalate as disclosed in GB 1,293,676, GB 1,441,304 and GB 1,454,956.

The support may be in sheet, ribbon or web form and subbed or pretreated, if need be to improve the adherence to the thereon coated thermosensitive element or photo-addressable thermally developable element.

Suitable subbing layers for improving the adherence of the thermosensitive element or photo-addressable thermally developable element of the substantially light-insensitive thermographic and photothermographic recording materials of the present invention to polyethylene terephthalate supports are described e.g. in GB-P 1,234,755, U.S. Pat. Nos. 3,397,988; 3,649,336; 4,123,278, U.S. Pat. No. 4,478,907 and in Research Disclosure published in Product Licensing Index, July 1967, p. 6.

Suitable pretreatments of hydrophobic resin supports are, for example, treatment with a corona discharge and/or attack by solvent(s), thereby providing a micro-roughening.

The transparent or translucent support may be colourless or coloured, e.g. having a blue colour.

Protective Layer

The outermost layer of the (photo)thermographic recording material on the same side of the support as the thermosensitive element or photo-addressable thermally developable element, used in the present invention, may be a protective layer to avoid local deformation of the thermosensitive element or photo-addressable thermally developable element and to improve resistance against abrasion.

The protective layer preferably comprises a binder, which may be hydrophobic (solvent soluble) of hydrophilic (water soluble). Particularly preferred hydrophobic binders are the polycarbonates described in EP-A 614 769. Hydrophilic binders are, however, preferred for the protective layer, as coating can be performed from an aqueous composition and mixing of the hydrophilic protective layer with the immediate underlayer can be avoided by using a hydrophobic binder in the immediate underlayer.

A protective layer used in the present invention may also contain at least one solid lubricant having a melting point below 150° C. and at least one liquid lubricant at least one of these lubricants being a phosphoric acid derivative; and additional dissolved lubricating material and/or particulate material, e.g. talc particles, optionally protruding from the outermost layer. Examples of suitable lubricating materials are surface active agents, liquid lubricants, solid lubricants which do not melt during thermal development of the recording material, solid lubricants which melt (thermomeltable) during thermal development of the recording material or mixtures thereof. The lubricant may be applied with or without a polymeric binder.

Such protective layers may also contain particulate material, e.g. talc particles, optionally protruding from the protective outermost layer as described in WO 94/11198. Other additives can also be incorporated therein e.g. colloidal particles such as colloidal silica.

Antihalation Dyes

In addition to the ingredients, the substantially light-insensitive thermographic and photothermographic recording materials of the present invention may contain antihalation or acutance dyes which absorb light which has passed through the photosensitive layer, thereby preventing its reflection. Such dyes may be incorporated into the thermosensitive element, photo-addressable thermally developable element or in any other layer of the substantially light-insensitive thermographic or photothermographic recording material of the present invention. The antihalation dye may also be bleached either thermally during the thermal development process, as disclosed in the U.S. Pat. Nos. 4,033,948, 4,088,497, 4,153,463, 4,196,002, 4,201,590, 4,271,263, 4,283,487, 4,308,379, 4,316,984, 4,336,323, 4,373,020, 4,548,896, 4,594,312, 4,977,070, 5,258,274, 5,314,795 and 5,312,721, or photo-bleached after the thermal development process, as disclosed in the U.S. Pat. Nos. 3,984,248, 3,988,154, 3,988,156, 4,111,699 and 4,359,524. Furthermore the antihalation dye may be contained in a layer which can be removed subsequent to the exposure process, as disclosed in U.S. Pat. No. 4,477,562 and EP-A 491 457. Suitable antihalation dyes for use with infra-red light are described in the EP-A's 377 961 and 652 473, the EP-B's 101 646 and 102 781 and the U.S. Pat. Nos. 4,581,325 and 5,380,635.

Antistatic Layer

The photothermographic materials according to the present invention may further include an antistatic layer. Suitable antistatic layers are described in EP-A's 444 326, 534 006 and 644 456, U.S. Pat. Nos. 5,364,752 and 5,472,832 and DOS 4125758. Particularly preferred antistatic layers are those based on polythiophene as disclosed in EP-A 628 560, U.S. Pat. No. 5,354,613, U.S. Pat. No. 5,372,924, U.S. Pat. No. 5,370,981 and U.S. Pat. No. 5,391,472.

Photo-addressable Thermally Developable Element

The photo-addressable thermally developable element used in the present invention comprises a substantially light-insensitive organic silver salt and an organic reducing agent therefor in thermal working relationship therewith, photosensitive silver halide in catalytic association with the substantially light-insensitive organic silver salt and a binder. The photo-addressable thermally developable element may comprise a layer system in which the ingredients may be dispersed in different layers, with the proviso that the substantially light-insensitive organic silver salt and the organic reducing agent are in thermal working relationship with one another i.e. during the thermal development process the reducing agent must be present in such a way that it is able to diffuse to the substantially light-insensitive organic silver salt particles so that reduction of the organic silver salt can take place; and the photosensitive silver halide is in catalytic association with the substantially light-insensitive organic silver salt.

Photosensitive Silver Halide

The photosensitive silver halide used in the present invention may be employed in a range of 0.1 to 90 mol percent; preferably, from 0.2 to 50 mol percent; particularly preferably from 0.5 to 35 mol %; and especially from 1 to 12 mol % of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Emulsion of Organic Silver Salt and Photosensitive Silver Halide

The silver halide may be added to the photo-addressable thermally developable element in any fashion which places it in catalytic proximity to the substantially light-insensitive organic silver salt. Photosensitive silver halide and substantially light-insensitive organic silver salt which are separately formed, i.e. ex-situ or "preformed", in a binder can be mixed prior to use to prepare a coating solution, but they may be blended for a long period of time prior to use. Furthermore, a process may be used in which a halogen-containing compound is added to the organic silver salt to partially convert the substantially light-insensitive organic silver salt to silver halide, as disclosed in U.S. Pat. No. 3,457,075.

A particularly preferred mode of preparing the emulsion of organic silver salt and photosensitive silver halide for coating of the photo-addressable thermally developable element from solvent media, according to the present invention is that disclosed in U.S. Pat. No. 3,839,049, but other methods such as those described in Research Disclosure, June 1978, item 17029 and U.S. Pat. No. 3,700,458 may also be used.

A suspension of particles containing a substantially light-insensitive silver salt of an organic carboxylic acid is disclosed in EP-A 754 969. A particularly preferred mode of preparing the emulsion of organic silver salt and photosensitive silver halide for coating of the photo-addressable thermally developable element from aqueous media, according to the present invention is that disclosed in unpublished PCT patent application PCT/EP/96/02580, which discloses a photothermographic recording material comprising a photo-addressable thermally developable element comprising a substantially light-insensitive organic silver salt, photosensitive silver halide in catalytic association with the substantially light-insensitive organic silver salt, a reducing agent in thermal working relationship with the substantially light-insensitive organic silver salt and a binder, characterized in that the binder comprises a water-soluble polymer, a water-dispersible polymer or a mixture of a water-soluble polymer and a water-dispersible polymer and particles of the photosensitive silver halide are non-aggregating in the photo-addressable thermally developable element and are uniformly distributed over and between particles of the substantially light-insensitive organic silver salt, at least 80% by number of the particles having a diameter, determined by transmission electron microscopy, of $\leqq$40 nm.

Spectral Sensitizer

The photo-addressable thermally developable element of the photothermographic recording material, according to the present invention, may contain a spectral sensitizer, optionally together with a supersensitizer, for the silver halide. The silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. Of the above described cyanine and merocyanine dyes, those having imino groups or carboxyl groups are particularly suitable. Suitable sensitizers of silver halide to infra-red radiation include those disclosed in EP-A's 465 078, 559 101, 616 014 and 635 756, JN's 03-080251, 03-163440, 05-019432, 05-072662 and 06-003763 and U.S. Pat. Nos. 4,515,888, 4,639,414, 4,713,316, 5,258,282 and 5,441,866. Suitable supersensitizers for use with infra-red spectral sensitizers are disclosed in EP-A's 559 228 and 587 338 and in U.S. Pat. Nos. 3,877,943 and 4,873,184.

Coating

The coating of any layer of the (photo)thermographic recording materials of the present invention may proceed by any thin-film coating technique known in the art. In the coating of web type supports for photographic materials slide hopper coating is preferred, but other coating techniques such as dip coating and air knife coating may also be used. Details about such coating techniques can be found in "Modern Coating and Drying Technology" by Edward D. Cohen and Edgar B. Gutoff, published by VCH Publishers, Inc. 220 East 23rd Street, Suite 909 New York, N.Y. 10010.

Processing Configurations for Thermographic Recording Materials

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, or by direct thermal imaging with a thermal head.

"Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–502 describes the conversion of thermal printing image signals into electric pulses and their transmission through a driver circuit to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. The operating temperature of common thermal printheads is in the range of 300 to 400° C. and the heating time per picture element (pixel) may be 50 ms or less, the pressure contact of the thermal printhead with the recording material being e.g. 100–500 g/cm$^2$ to ensure a good transfer of heat.

In order to avoid direct contact of the thermal printing heads with a recording material not provided with an outermost protective layer, the imagewise heating of the recording material with the thermal printing heads may proceed through a contacting but removable resin sheet or web wherefrom during the heating no transfer of recording material can take place.

In a particular embodiment of the method according to the present invention the direct thermal image-wise heating of the recording material proceeds is carried out with a thermal head. Suitable thermal printing heads are e.g. a Fujitsu Thermal Head (FTP-040 MCS001), a TDK Thermal Head F415 HH7-1089 and a Rohm Thermal Head KE 2008-F3. Activation of the heating elements can be power-modulated or pulse-length modulated at constant power.

EP-A 622 217 discloses a method for producing a continuous tone image by heating the thermal recording element by means of a thermal head having a plurality of heating elements.

Recording Process for Photothermographic Recording Materials

Photothermographic recording materials, according to the present invention, may be exposed with radiation of wavelength between an X-ray wavelength and a 5 microns wavelength with the image either being obtained by pixel-wise exposure with a finely focussed light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating with for example a heated roller or a thermal head, radiative heating, microwave heating etc.

Applications

The substantially light-insensitive thermographic and photothermographic recording materials of the present invention can be used for the production of transparencies, which are widely used in graphics applications, e.g. in masks or for display purposes, and in the medical diagnostic field in which black-imaged transparencies are widely used in inspection techniques operating with a light box.

Application of the present invention is envisaged in the fields of both graphics images requiring high contrast images with a very steep print density applied dot energy dependence and continuous tone images requiring a weaker print density applied dot energy dependence, such as required in the medical diagnostic field.

The following ingredients were used in the invention and comparative examples of the present invention:

Backside Layer

CAB: cellulose acetate butyrate, CAB-171-15S from EASTMAN; AH01 (antihalation dye):

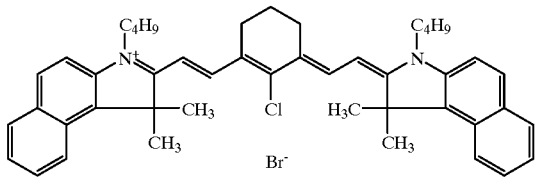

Photo-addressable Thermally Developable Element i) silver behenate/silver halide emulsion layer GEL: phthaloylgelatin, type 16875 from ROUSSELOT;

SENSI:

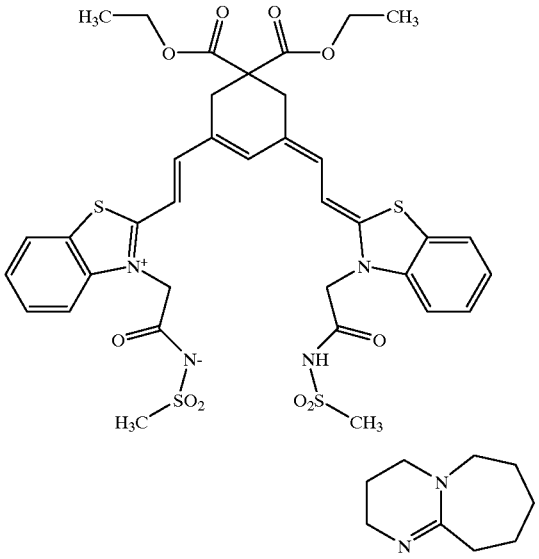

Butvar™ B76: polyvinylbutyral from MONSANTO;

LOWINOX™ 22IB46: 2-propyl-bis(2-hydroxy-3,5-dimethylphenyl)methane from CHEM. WERKE LOWI;

TMABP: tetramethylammonium bromide perbromide;

TMPS: tribromomethyl benzenesulfinate;

MBI: 2-mercaptobenzimidazole;

ii) protective layer

CAB: cellulose acetate butyrate, CAB-171-15S from EASTMAN;

PMMA: polymethylmethacrylate, Acryloid™ K120N from ROHM & HAAS.

LOWINOX™ 22IB46: 2-propyl-bis(2-hydroxy-3,5-dimethylphenyl)methane from CHEM. WERKE LOWI;

The following examples illustrate the present invention without however limiting it thereto. All percentages, parts and ratios are by weight unless otherwise mentioned.

COMPARATIVE EXAMPLES 1 to 4

Blue Support

A polyethylene terephthalate (PET) foil pigmented with a blue pigment was first coated on both sides with a subbing layer consisting of a terpolymer latex of vinylidene chloride-methyl acrylate-itaconic acid (88/10/2) in admixture with colloidal silica (surface area 100 $m^2/g$). After stretching the foil in the transverse direction the foil had a thickness of 175 $\mu$m with coverages of the terpolymer and of the silica in the subbing layers of 170 $mg/m^2$ and 40 $mg/m^2$ respectively on each side of the PET-foil.

Backside Layer

The backside layers of the photothermographic recording materials of COMPARATIVE EXAMPLES 1 to 4 were prepared by doctor blade coating one side of the thus subbed PET-foil with 70 ml of a 2-butanone dispersion or solution containing CAB and the antihalation dye AH01 at a blade setting of 100 $\mu$m slit to a wet-layer thickness of 70 $\mu$m. After allowing to dry at room temperature for 3 minutes without forced air ventilation, the layers were dried for 5 minutes in a drying cupboard at 75° C., also without forced air ventilation, thereby producing the layer compositions given in table 1 below:

TABLE 1

| | PET type | CAB [$g/m^2$] | AH01 [$mg/m^2$] |
|---|---|---|---|
| COMPARATIVE EXAMPLE 1 | blue | 2.70 | 0 |
| COMPARATIVE EXAMPLE 2 | blue | 2.70 | 10 |
| COMPARATIVE EXAMPLE 3 | blue | 2.70 | 20 |
| COMPARATIVE EXAMPLE 4 | blue | 2.70 | 50 |

The transmission absorption spectra of the backside layers of the photothermographic recording materials of COMPARATIVE EXAMPLES 1 and 4 were spectrophotometrically evaluated using a DIANO™ MATCHSCAN spectrophotometer to obtain the absorption maxima in the wavelength range 550 to 700 nm and the absorbances at these absorption maxima. The results are summarized in table 2 below:

TABLE 2

| | AH01 | in wavelength range 550 to 700 nm | |
|---|---|---|---|
| | [$mg/m^2$] | $\lambda_{max}$ [nm] | $D_{max}$ |
| COMPARATIVE EXAMPLE 1 | 0 | 589; 635 | 0.26; 0.27 |
| COMPARATIVE EXAMPLE 4 | 50 | 589; 635 | 0.27; 0.30 |

Silver Halide Emulsion

A silver halide emulsion consisting of 3.11% by weight of silver halide particles consisting of 97 mol % silver bromide and 3 mol % silver iodide with an weight average particle size of 50 nm, 0.47% by weight of GEL as dispersing agent in deionized water was prepared using conventional silver halide preparation techniques such as described, for example, in T. H. James, "The Theory of the Photographic Process", Fourth Edition, Macmillan Publishing Co. Inc., New York (1977), Chapter 3, pages 88–104.

Silver Behenate/silver Halide Emulsion

The silver behenate/silver halide emulsion was prepared by adding a solution of 6.8 kg of behenic acid in 67L of 2-propanol at 65° C. to a 400 L vessel heated to maintain the temperature of the contents at 65° C., converting 96% of the behenic acid to sodium behenate by adding with stirring 76.8L of 0.25M sodium hydroxide in deionized water, then adding with stirring 10.5 kg of the above-described silver halide emulsion at 40° C. and finally adding with stirring 48L of a 0.4M solution of silver nitrate in deionized water. Upon completion of the addition of silver nitrate the contents of the vessel were allowed to cool and the precipitate filtered off, washed, slurried with water, filtered again and finally dried at 40° C. for 72 hours.

7 kg of the dried powder containing 9 mol % silver halide and 4 mol % behenic acid with respect to silver behenate were then dispersed in a solution of 700 g of Butvar™ B76 in 15.6 kg of 2-butanone using conventional dispersion techniques yielding a 33% by weight dispersion. 7.4 kg of 2-butanone were then added and the resulting dispersion homogenized in a microfluidizer. Finally 2.8 kg of Butvar™ B76 were added with stirring to produce a dispersion with 31% by weight of solids.

Coating and Drying of Silver Behenate/silver Halide Emulsion Layer

The emulsion layer coating compositions for the photothermographic recording materials of COMPARATIVE EXAMPLES 1 to 4 were prepared by adding the following solutions or liquids to 40.86 g of the above-mentioned silver behenate/silver halide emulsion in the following sequence with stirring: 10.87 g of 2-butanone, 0.75 g of a 9% solution of TMABP in methanol followed by 2 hours stirring, 1.3 g of 2-butanone, 0.2 g of a 11% solution of calcium bromide in methanol and 1.3 g of 2-butanone followed by 30 minutes stirring, a solution consisting of 0.21 g of LOWINOX™ 22IB46, 0.5 g of TMPS and 9.24 g of 2-butanone followed by 10 minutes stirring, 1.84 g of a 0.11% methanol solution of SENSI followed by 30 minutes stirring and finally 4.35 g of Butvar™ B76 were added followed by 45 minutes of stirring and then 4.79 g of 2-butanone.

The PET-support subbed and coated with a backside layer as described above was then doctor blade-coated at a blade setting of 150 μm on the side of the support not coated with a backside layer with the coating composition to a wet layer thickness of 80 μm followed by drying for 5 minutes at 80° C. on an aluminium plate in a drying cupboard.

Protective Layer

A protective layer coating composition for the photothermographic recording materials of COMPARATIVE EXAMPLES 1 to 4 was prepared by dissolving 4.08 g of CAB and 0.16 g of PMMA in 36.3 g of 2-butanone and 4.16 g of methanol adding the following solids or solution with stirring in the following sequence: 0.5 g of phthalazine, 0.2 g of 4-methylphthalic acid, 0.1 g of tetrachloro-phthalic acid, 0.2 g of tetrachlorophthalic acid anhydride and a solution consisting of 2.55 g of LOWINOX™ 22IB46 and 5.95 g 2-butanone.

The emulsion layer was then doctor blade-coated at a blade setting of 100 μm with the protective layer coating composition to a wet layer thickness of 57 μm, which after drying for 8 minutes at 80° C. on an aluminium plate in a drying cupboard produced a layer with the following composition:

| | |
|---|---|
| CAB | 4.08 g/m$^2$ |
| PMMA | 0.16 g/m$^2$ |
| Phthalazine | 0.50 g/m$^2$ |
| 4-methylphthalic acid | 0.20 g/m$^2$ |
| tetrachlorophthalic acid | 0.10 g/m$^2$ |
| tetrachlorophthalic acid anhydride | 0.20 g/m$^2$ |
| LOWINOX ™ 22IB46 | 2.55 g/m$^2$ |

Image-wise Exposure and Thermal Processing

The photothermographic recording materials of COMPARATIVE EXAMPLES 1 to 4 were exposed for 1 s to a 750W lamp through a L775-filter and a wedge filter varying between 0 and 3.0 in steps of 0.15.

Thermal processing was carried out for 10 s with the side of the support provided with a silver behenate/silver halide emulsion layer in contact with a drum heated to a temperature of 121° C.

The optical densities of the resulting images were measured in transmission with a MacBeth™ TR924 densitometer through a visible filter to produce a sensitometric curve for the photothermographic recording materials from which the maximum and minimum optical densities, $D_{max}$ and $D_{min}$, and the relative sensitities for $D_{min}$+1.0 determined. The image sharpness was assessed qualitatively using the following numerical codes:

0=unacceptable image sharpness

1=poor image sharpness

2=acceptable image sharpness

3=good image sharpness

The $D_{max}$-and $D_{min}$-values and the relative sensitivity values to obtain an optical density of $D_{min}$+1.0 obtained upon image-wise exposure and thermal processing of the photothermographic recording materials of COMPARATIVE EXAMPLES 1 to 4 together with the thermal processing conditions used and the image sharpness assessments are summarized in table 3.

TABLE 3

| Comparative example number | thermal processing conditions: temperature [° C.] | time [s] | $D_{max}$ | $D_{min}$ | Relative sensitivity at $D_{min}$ + 1.0 | Image sharpness |
|---|---|---|---|---|---|---|
| 1 | 121 | 10 | 4.4 | 0.53 | 1.7 | 0 |
| 2 | 121 | 10 | 4.2 | 0.40 | 2.4 | 1 |
| 3 | 121 | 10 | 4.2 | 0.43 | 2.3 | 2 |
| 4 | 121 | 10 | 4.8 | 0.39 | 2.6 | 3 |

INVENTION EXAMPLES 1 to 6

Substantially Colourless Support

A 175 μm substantially colourless polyethylene terephthalate (PET) foil was produced as described for the blue support for COMPARATIVE EXAMPLES 1 to 4 except that the PET foil was not pigmented with a blue pigment.

Backside Layer

The backside layers of the photothermographic recording materials of INVENTION EXAMPLES 1 to 6 were prepared by doctor blade coating one side of the thus subbed PET-foil as described for COMPARATIVE EXAMPLES 1 to 4 except that the 2-butanone coating solution or dispersion contained blue dye in addition to CAB and antihalation dye AH01. The backside layer compositions thus produced are given in table 4 below:

TABLE 4

| Invention example number | PET type | CAB [g/m$^2$] | Blue dye No. | Blue dye [mg/m$^2$] | AH01 [mg/m$^2$] |
|---|---|---|---|---|---|
| I | colourless | 2.70 | 01 | 120 | 0 |
| 2 | colourless | 2.70 | 01 | 120 | 10 |
| 3 | colourless | 2.70 | 01 | 120 | 30 |
| 4 | colourless | 2.70 | 01 | 120 | 50 |
| 5 | colourless | 2.70 | 02 | 120 | 50 |
| 6 | colourless | 2.70 | 03 | 120 | 50 |

The transmission absorption spectra of the backside layers of the photothermographic recording material of INVENTION EXAMPLES 1, 4, 5 and 6 were spectrophotometrically evaluated as described for COMPARATIVE EXAMPLES 1 and 4.

TABLE 5

| Invention example | Blue dye | | AH01 | in wavelength range 550 to 700 nm | |
|---|---|---|---|---|---|
| number | No. | [mg/m$^2$] | [mg/m$^2$] | $\lambda_{max}$ [nm] | $D_{max}$ |
| 1 | 01 | 120 | 0 | 588; 632 | 0.25; 0.28 |
| 4 | 01 | 120 | 50 | 589; 634 | 0.28; 0.32 |
| 5 | 02 | 120 | 50 | 675 | 0.40 |
| 6 | 03 | 120 | 50 | 630 | 0.33 |

Silver Behenate/Silver Halide Emulsion Layer and Protective Layer

The silver behenate/silver halide emulsion layer and protective layers were produced as described for COMPARATIVE EXAMPLES 1 to 4.

Image-wise Exposure and Thermal Processing

The photothermographic recording materials of INVENTION EXAMPLES 1 to 6 were exposed and thermally processed as described for COMPARATIVE EXAMPLES 1 to 4. The maximum and minimum optical densities, $D_{max}$ and $D_{min}$, of the images, the relative sensitivites for $D_{min}$+1.0 and the image sharpnesses were determined as described for COMPARATIVE EXAMPLES 1 to 4.

The $D_{max}$-and $D_{min}$-values and the exposure values to obtain an optical density of $D_{min}$+1.0 obtained upon image-wise exposure and thermal processing of the photothermographic recording materials of INVENTION EXAMPLES 1 to 6 together with the processing conditions used and the image sharpness assessments are summarized in table 6. If the results in table 6 are compared with those for photothermographic recording materials with the same quantities of the antihalation dye AH01 in table 3, no sensitometric influence of using a substantially transparent support instead of a blue support together with incorporating a blue dye or pigment in the backside layer can be established.

TABLE 6

| Invention | thermal processing conditions | | | | Relative | Image |
|---|---|---|---|---|---|---|
| example number | temperature [° C.] | time [s] | $D_{max}$ | $D_{min}$ | sensitivity at $D_{min}$ + 1.0 | sharpness |
| 1 | 121 | 10 | 3.6 | 0.53 | 1.8 | 0 |
| 2 | 121 | 10 | 4.6 | 0.39 | 2.5 | 1 |
| 3 | 121 | 10 | 3.1 | 0.46 | 2.4 | 2 |
| 4 | 121 | 10 | 4.0 | 0.63 | 2.6 | 3 |

A photothermographic recording material with a blue background can therefore be obtained by incorporating a blue dye or pigment in the backside layer and using a substantially transparent support with the advantage that the holding of an inventory of different sorts of blue background support as well as substantially colourless supports is no longer necessary, the danger of using the "wrong" sort of support for the production of a particular substantially light-insensitive thermographic recording material or photothermographic recording material is avoided and the use of more expensive pigments and dyes in the colouring of the support, due to the harsher conditions involved in the incorporation process, is no longer necessary.

INVENTION EXAMPLE 9

The sort of unpigmented support used for the photothermographic recording materials of INVENTION EXAMPLES 1 to 6 was used for the photothermographic recording material of INVENTION EXAMPLE 9. This was coated with a backside layer as described for COMPARATIVE EXAMPLE 4; a silver behenate/silver halide emulsion layer as described for COMPARATIVE EXAMPLES 1 to 4 except that 120 mg of DYE 01 was added to the coating emulsion; and the silver behenate/silver halide emulsion layer was coated with a protective layer as described for COMPARATIVE EXAMPLES 1 to 4.

The photothermographic recording material of INVENTION EXAMPLE 9 was exposed and thermally processed as described for COMPARATIVE EXAMPLES 1 to 4. The sensitometric properties of the photothermographic material of INVENTION EXAMPLE 9 in which DYE 01 had been added to the silver behenate/silver halide emulsion layer and a substantially transparent support had been used was found not to differ from that of COMPARATIVE EXAMPLE 4 with a blue support and the same quantity of antihalation dye AH01 in the backside layer.

A photothermographic recording material with a blue background can therefore be obtained by incorporating a blue dye or pigment in the silver behenate/silver halide emulsion layer together with a substantially transparent support with the advantage that the holding of an inventory of different sorts of blue background support as well as substantially colourless supports is no longer necessary, the danger of using the "wrong" sort of support for the production of a particular substantially light-insensitive thermographic recording material or photothermographic recording material is avoided and the use of more expensive pigments and dyes in the colouring of the support, due to the harsher conditions involved in the incorporation process, is no longer necessary.

Having described in detail preferred embodiments of the current invention, it will now be apparent to those skilled in the art that numerous modifications can be made therein without departing from the scope of the invention as defined in the following claims.

What is claimed is:

1. A substantially light-insensitive thermographic recording material comprising a substantially colourless support and a thermosensitive element, said thermosensitive element containing a substantially light-insensitive organic silver salt, an organic reducing agent for said substantially light-insensitive organic silver salt in thermal working relationship therewith and a binder, wherein a blue pigment or dye having an absorption maximum in the wavelength range from 550 to 700 nm is uniformly distributed in said thermosensitive element and/or uniformly distributed in a layer on either side of said support, which blue pigment or dye provides a background for viewing in transmission images produced with said substantially light-insensitive thermographic recording material, and wherein said blue pigment or dye is selected from the group consisting of phthalocyanine dyes, phthalocyanine pigments, indanthrone dyes and indanthrone pigments.

2. The substantially light-insensitive thermographic recording material according to claim 1, wherein said blue pigment or dye has an absorption maximum in the wavelength range from 570 to 630 nm.

3. A thermographic recording process comprising the steps of:

(a) bringing a substantially light-insensitive thermographic recording material comprising a substantially colourless support and a thermosensitive element, said thermosensitive element containing a substantially light-insensitive organic silver salt, an organic reducing agent for said substantially light-insensitive organic silver salt in thermal working relationship therewith and a binder into the proximity of a heat source and (b) imagewise heating of said substantially light-insensitive thermographic recording material with said heat source, wherein a blue pigment or dye having an absorption maximum in the wavelength range from 550 to 700 nm is uniformly distributed in said thermosensitive element and/or uniformly distributed in a layer on either side of said support, which blue pigment or dye provides a background for viewing in transmission images produced with said substantially light-insensitive thermographic recording material, and wherein said blue pigment or dye is selected from the group consisting of phthalocyanine dyes, phthalocyanine pigments, indanthrone dyes and indanthrone pigments.

* * * * *